US011581122B2

(12) United States Patent
Sasaki

(10) Patent No.: US 11,581,122 B2
(45) Date of Patent: Feb. 14, 2023

(54) MAGNETIC PART AND ELECTRONIC APPARATUS

(71) Applicant: Omron Corporation, Kyoto (JP)

(72) Inventor: Satoru Sasaki, Aichi (JP)

(73) Assignee: Omron Corporation, Kyoto (JP)

( * ) Notice: Subject to any disclaimer, the term of this patent is extended or adjusted under 35 U.S.C. 154(b) by 560 days.

(21) Appl. No.: 16/410,811

(22) Filed: May 13, 2019

(65) Prior Publication Data

US 2019/0355507 A1 Nov. 21, 2019

(30) Foreign Application Priority Data

May 18, 2018 (JP) ..... JP2018-095852

(51) Int. Cl.

| | |
|---|---|
| ***H01F 27/08*** | (2006.01) |
| ***H01F 27/28*** | (2006.01) |
| ***H01F 27/02*** | (2006.01) |
| ***H01F 27/26*** | (2006.01) |

(52) U.S. Cl.

CPC ..... *H01F 27/2804* (2013.01); *H01F 27/02* (2013.01); *H01F 27/263* (2013.01)

(58) Field of Classification Search

CPC .... H01F 27/2804; H01F 27/02; H01F 27/263; H01F 2017/046; H01F 3/14; H01F 27/266; H01F 27/2847; H01F 27/24; H01F 27/22; H01F 2027/065; H01F 27/085

See application file for complete search history.

(56) References Cited

U.S. PATENT DOCUMENTS 5,210,513 A * 5/1993 Khan ..... H01F 27/22 336/83
8,786,391 B2 * 7/2014 Nobusaka ..... H01F 27/266 336/67
9,824,810 B2 * 11/2017 Eom ..... H01F 27/02

(Continued)

FOREIGN PATENT DOCUMENTS

CN 102782783 A 11/2012
CN 103219135 A 7/2013

(Continued)

OTHER PUBLICATIONS

Office Action issued in corresponding Chinese Application No. 201910344140.3, dated Jun. 30, 2021 with English translation (16 pages).

(Continued)

*Primary Examiner* — Mang Tin Bik Lian

(74) *Attorney, Agent, or Firm* — Osha Bergman Watanabe & Burton LLP

(57) ABSTRACT

A magnetic part including: a coil that generates a magnetic flux when a current flows through the coil; a core that is formed of a magnetic substance that forms a magnetic path of the magnetic flux; a support member that supports the core; and a fixing member that fixes the core to the support member. The core includes a column portion that is vertically provided with respect to a surface where the core is in contact with the support member. The fixing member presses the column portion of the core against the support member. The support member has a recess in a portion of a facing surface that faces the core, where the portion of a facing surface does not face the column portion.

7 Claims, 6 Drawing Sheets

(56) References Cited

U.S. PATENT DOCUMENTS

| | | | | |
|---|---|---|---|---|
| 2006/0082945 | A1* | 4/2006 | Walz | H01F 27/22 361/103 |
| 2012/0092120 | A1 | 4/2012 | Yoshikawa et al. | |
| 2012/0126928 | A1 | 5/2012 | Yoshikawa et al. | |
| 2012/0154093 | A1 | 6/2012 | Yoshikawa et al. | |
| 2012/0161911 | A1* | 6/2012 | Moiseev | H01F 27/02 336/55 |
| 2012/0313740 | A1 | 12/2012 | Inaba et al. | |
| 2013/0021124 | A1* | 1/2013 | Kulke | H01F 7/1615 335/229 |
| 2013/0181801 | A1 | 7/2013 | Yoshikawa et al. | |
| 2013/0265129 | A1* | 10/2013 | Ansari | H01F 27/22 336/61 |
| 2013/0314185 | A1* | 11/2013 | Eom | H01F 27/22 336/60 |
| 2014/0125308 | A1 | 5/2014 | Yoshikawa et al. | |
| 2015/0042431 | A1 | 2/2015 | Delalandre et al. | |
| 2015/0279550 | A1* | 10/2015 | Kitami | H01F 27/30 336/178 |
| 2015/0294782 | A1* | 10/2015 | Moiseev | H01F 27/2866 336/61 |
| 2017/0032888 | A1* | 2/2017 | Park | H01F 27/325 |
| 2019/0019609 | A1* | 1/2019 | Fujii | H01F 27/2804 |
| 2019/0148049 | A1 | 5/2019 | Takiguchi et al. | |

FOREIGN PATENT DOCUMENTS

| | | | | |
|---|---|---|---|---|
| CN | 103827993 | A | | 5/2014 |
| CN | 206331879 | U | | 7/2017 |
| CN | 107275051 | A | | 10/2017 |
| CN | 107610912 | A | | 1/2018 |
| JP | S53046510 | A | | 4/1978 |
| JP | S60-31232 | Y2 | | 9/1985 |
| JP | 2001-143938 | A | | 5/2001 |
| JP | 2004095570 | A | * | 3/2004 |
| JP | 2004-303816 | A | | 10/2004 |
| JP | 2009-303285 | A | | 12/2009 |
| JP | 2011-181804 | A | | 9/2011 |
| JP | 4888324 | B2 | | 2/2012 |
| JP | 2014086432 | A | | 5/2014 |
| WO | 2017221804 | A1 | | 12/2017 |

OTHER PUBLICATIONS

Office Action issued in corresponding Japanese Application No. 2018-095852; dated Mar. 2, 2022 (6 pages).

* cited by examiner

--Prior Art--

--Prior Art--

--Prior Art--

MAGNETIC PART AND ELECTRONIC APPARATUS

CROSS-REFERENCES TO RELATED APPLICATIONS

This application is based upon and claims the benefit of priority from Japanese Patent Application No. 2018-095852, filed on May 18, 2018; the entire contents of which are incorporated herein by reference.

FIELD

One or more embodiments of the present invention relate to a magnetic part that includes a coil and a core formed of a magnetic substance, and an electronic apparatus that includes the magnetic part, and particularly, to a structure for preventing breakage of the core.

BACKGROUND

For example, an electronic apparatus such as a DC-DC converter is provided with a magnetic part such as a choke coil or a former. Generally, such a magnetic part includes a coil and a core.

A coil is electrically connected to a board, an electrical wiring, or the like of an electronic apparatus, as disclosed in JP-A-2004-303816, JP-A-2011-181804, and JP-A-2009-303285, and generates a magnetic flux when a current flows through the coil. The core is formed of a ferrite magnetic substance material, or the like, and is provided to cover a most part of the coil. Further, the core forms a magnetic path of the magnetic flux generated by the coil.

As disclosed in JP-A-2004-303816, JP-A-2011-181804, and JP-A-2009-303285, the magnetic part is disposed on a support member such as a housing or a metallic plate provided in the electronic apparatus, and is fixed to the support member by a fixing member such as a fixing tool, a screw, or an adhesive.

When the current flows through the coil, the coil or the core radiates heat. Particularly, the amount of radiated heat of a coil or a core provided in a choke coil, a transformer, or the like in which a very high current flows is large. In a case where a temperature of the core exceeds a limit temperature due to the heat, the core does not function as a magnetic substance, and enters a state called thermal runaway, which causes deterioration of performance of the magnetic part.

As a solution, in the related art, for example, a configuration in which a support member is formed of a heat radiator and a core of a magnetic part is in close contact with the support member has been proposed. Further, JP-A-2011-181804 discloses a configuration in which leg portions are provided in a casing that is integrated with a core, the leg portions are fixed to a support member (housing) using screws, and a heat radiation space is provided between the core and the support member. Further, JP-A-2009-303285 discloses a configuration in which both end portions of a lower surface of a magnetic part are supported by a heat transfer layer and projection portions provided on an upper surface of a support member (metallic plate) and the thickness of an adhesive that causes the magnetic part to adhere to the support member is formed to be thin.

SUMMARY

For example, an external force such as vibration or shock is applied to an in-vehicle electronic apparatus from a vehicle body, a running driving source, or the like. Particularly, large external force such as vibration or shock from the engine is applied to an electronic apparatus that is provided in the vicinity of an engine while a vehicle is running, for example. It is necessary to reliably fix a core of a magnetic part that is provided in the electronic apparatus to a support member using a fixing member so that the core is not separated due to the large external force.

However, since the core is generally formed of a brittle material that is easily broken, such as a ferrite magnetic substance material, in a case where a large force is applied to the core from the fixing member, the core is likely to be broken. Specifically, as disclosed in JP-A-2004-303816, in a structure in which a core is pressed to a support member from the upside using a fixing member, in a case where a space is present between the core and the support member in a direction where a pressing force from the fixing member acts, a large bending stress or shearing stress is applied to the core, and thus, the core is easily broken. Further, in view of manufacturing of the core, there is variance in dimensions of the core, and thus, a warp may occur on a contact surface of the core that is in contact with the support member. In this case, a gap occurs between the core and the support member in the direction where the pressing force from the fixing member acts, and thus, the pressing force to the core from the fixing member and a reaction force to the core from the support member are not operated on the same line. Accordingly, a large bending stress or shearing stress is applied to the core, and thus, the core is easily broken. Further, in a case where the core is broken, the performance of a magnetic part or the performance of an electronic apparatus provided with the magnetic part deteriorates.

As a countermeasure of breakage of the core, there is a method for reducing a load when a core is pressed to a support member using a fixing member to such a degree that the core is not broken and performing adhesion, bonding, or the like, in addition to the fixing member, to fix the core to the support member to reinforce a fixing strength. However, according to the above-mentioned method, the number of manufacturing processes of the magnetic part or the electronic apparatus increases, which causes increase in the manufacturing cost.

One or more embodiments of the invention provide a technique capable of reliably fixing a core to a support member and preventing breakage of the core.

According to an aspect of the invention, there is provided a magnetic part including: a coil that generates a magnetic flux when a current flows through the coil; a core that is formed of a magnetic substance that forms a magnetic path of the magnetic flux; a support member that supports the core; and a fixing member that fixes the core to the support member. The core includes a column portion that is vertically provided with respect to a surface where the core is in contact with the support member. The fixing member presses the column portion of the core against the support member, and the support member has a recess in a portion of a facing surface that faces the core, where the portion of the facing surface does not face the column portion.

Further, according to another aspect of the invention, there is provided an electronic apparatus including: the above-described magnetic part; a board to which the coil of the magnetic part is electrically connected; and a housing that holds the magnetic part and the board.

According to the aspects of the invention, since the column portions of the core are pressed to the support member by the fixing members, a space is not present between the core and the support member in the direction where the pressing forces from the fixing members act. Accordingly, by suppressing a bending stress or shearing stress applied to the core to become small, it is possible to prevent breakage of the core. Further, since the recess is formed in a portion of the facing surface of the support member that faces the core, which is not in contact with the column portions, even though a warp occurs on the facing surface of the core that faces the support member, it is possible to cause only the column portions of the core on which the pressing forces from the fixing members act, on the facing surface of the core, to be in contact with the support member. Further, a gap between the core and the support member is not generated in the direction where the pressing forces from the fixing members act, and the pressing forces from the fixing members to the core and the reaction force from the support member to the core act on the same line. Thus, it is possible to suppress a bending stress or shearing stress applied to the core to become small, to thereby prevent breakage of the core. As a result, it is possible to reliably fix the core to the support member using the fixing members, and to prevent breakage of the core. Further, since a configuration in which pressing forces of fixing members to a core are reduced and adhesion, bonding, or the like is not employed to reinforce a fixing strength in addition to the fixing members, as conventional, it is possible to prevent increase in the number of manufacturing processes of the magnetic part or the electronic apparatus and increase in the manufacturing cost.

Further, in the aspects of the invention, the column portion may be provided in each of both end portions of the core in a direction parallel to the surface where the core is in contact with the support member, and the recess may be provided in the support member to be opened toward a space between the column portions.

Further, in the aspects of the invention, the core may be configured by combining two cores that are formed to have "E" shaped sections in a longitudinal direction such that projection portions formed in both end portions of the two cores in the longitudinal direction are in close contact with each other to form the column portions.

In the aspects of the invention, the support member may further include a stand that is vertically provided lateral to the core, and the fixing member may include a leaf spring, the leaf spring including a root portion fixed to the stand and a tip portion configured to press the column portion of the core against the support member.

Further, in the aspects of the invention, the support member may be formed of a heat radiator that radiates heat emitted from the core.

According to the aspects of the invention, it is possible to reliably fix a core to a support member, and to prevent the core from being broken.

DETAILED DESCRIPTION

Figure 1:
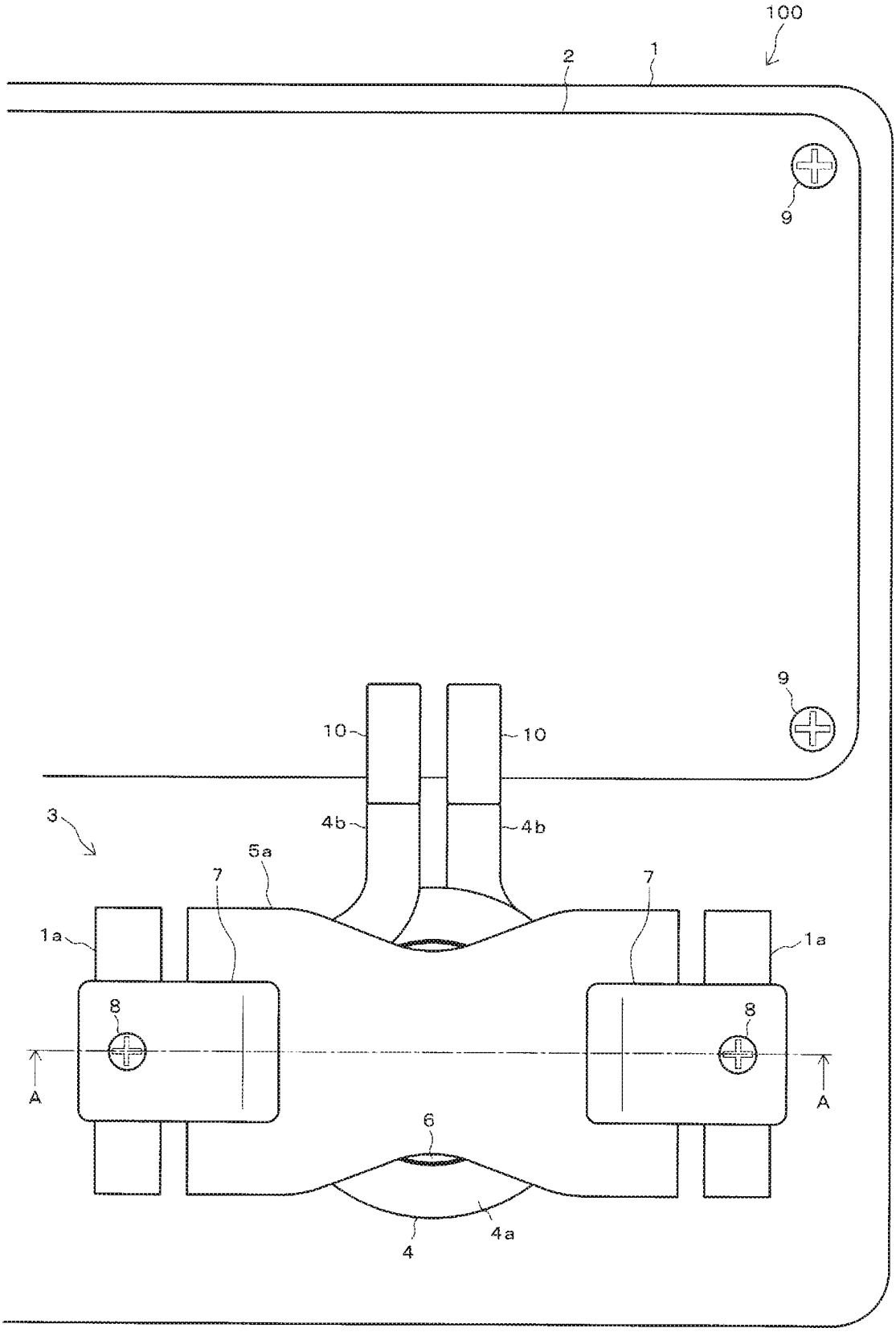
FIG. 1 is a plan view of a main portion of an electronic apparatus according to an embodiment of the invention.

In embodiments of the invention, numerous specific details are set forth in order to provide a thorough understanding of the invention. However, it will be apparent to one of ordinary skill in the art that the invention may be practiced without these specific details. In other instances, well-known features have not been described in detail to avoid obscuring the invention.

Hereinafter, the embodiments of the invention will be described with reference to the accompanying drawings. In the respective drawings, the same reference numerals are given to the same portions or corresponding portions.

Figure 2A:
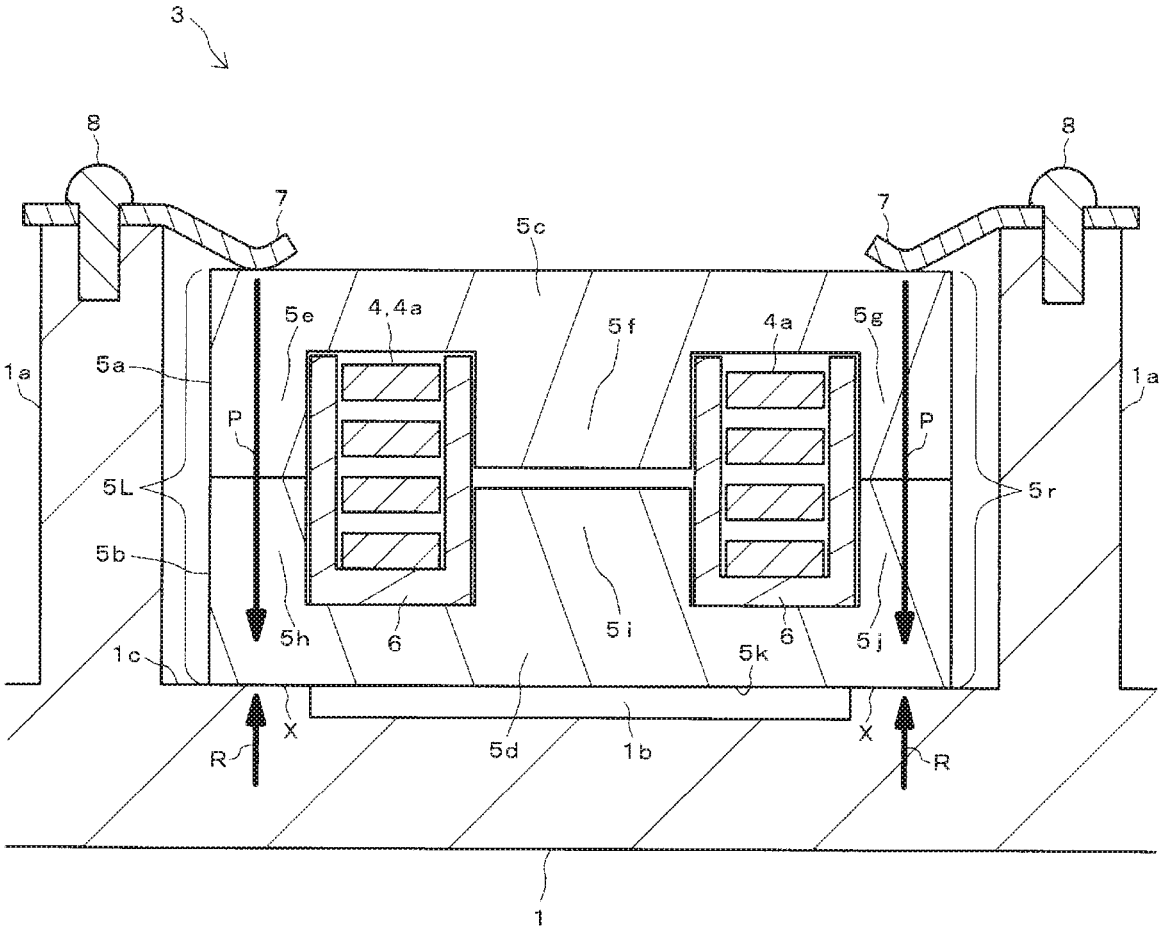
FIG. 2A is a section view of a magnetic part shown in FIG. 1.
Figure 2B:
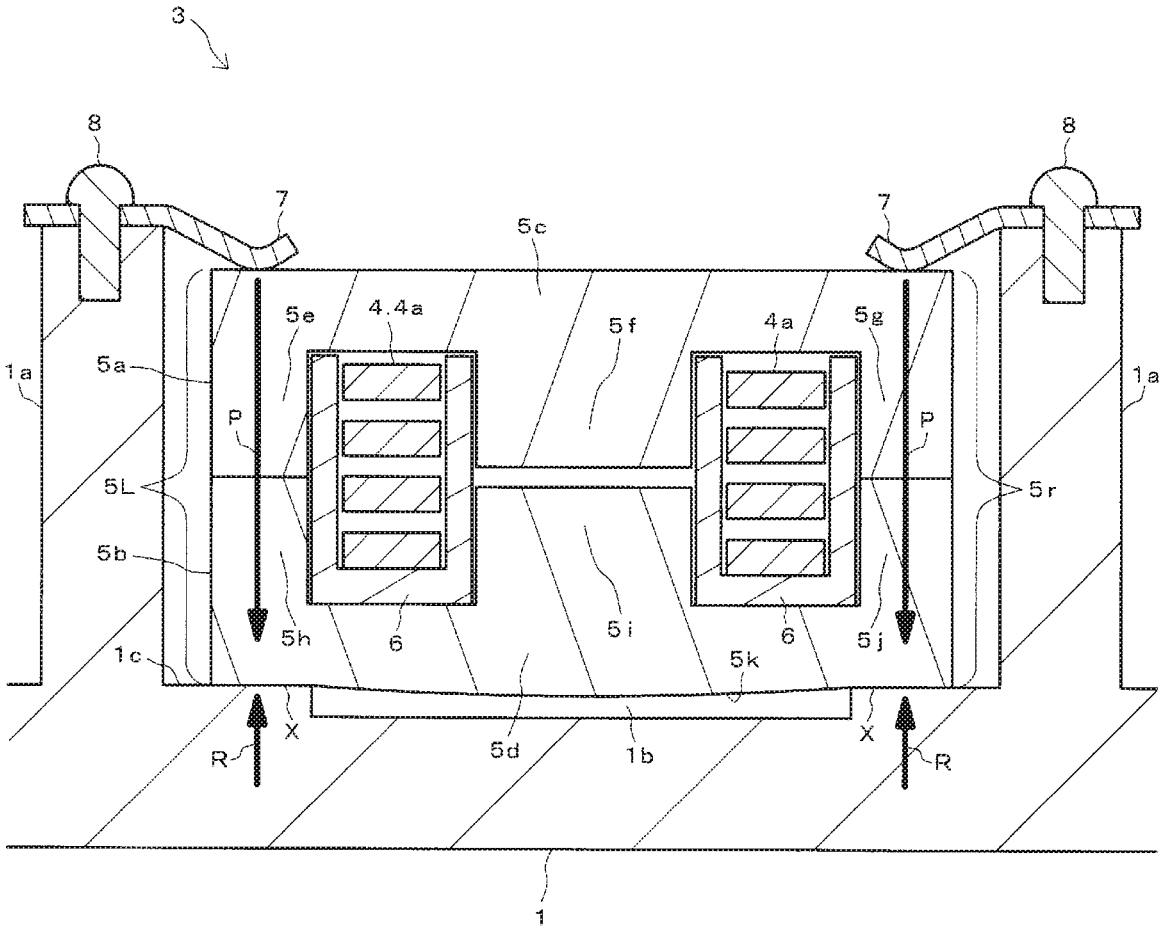
FIG. 2B is a section view of the magnetic part shown in FIG. 1.

FIG. 1 is a plan view of a main portion of an electronic apparatus 100 according to an embodiment of the invention. FIGS. 2A and 2B are section views (section views taken along A-A in FIG. 1) of a magnetic part 3 shown in FIG. 1.

The electronic apparatus 100 shown in FIG. 1 is an in-vehicle DC-DC converter, for example, and is provided in the vicinity of an engine of a vehicle. A housing 1 of the electronic apparatus 100 is formed of a heat radiator made of a metal material or a synthetic resin. The housing 1 holds a board 2, the magnetic part 3, and the like.

The board 2 is formed of a printed circuit board. The board 2 is fixed by screws 9 at a predetermined position on the housing 1. Although not shown in the figures, a plurality of electronic parts are mounted on the board 2, so that an electric circuit is formed. Further, an electronic part other than the magnetic part 3 is also fixed to the housing 1.

The magnetic part 3 is formed by a choke coil, for example. A coil 4 of the magnetic part 3 is formed by an edgewise coil having a section of a straight angle shape formed by sheet metal working, in this example, and generates a magnetic flux when a current flows through the coil 4. In order to cause a high current to stably flow in the coil 4, a cross-sectional area of a winding (flat wire) of the coil 4 is widened. In each of both edge portions of the coil 4, a terminal portion 4*b* for causing a current to flow in the coil 4 is provided. Each terminal portion 4*b* is extracted on one side of each of cores 5*a* and 5*b* (FIGS. 2A and 2B), and is electrically connected to one end of an electric wiring 10. The other end of the electric wiring 10 is electrically connected to the board 2 (FIG. 1). That is, the coil 4 is electrically connected with respect to the board 2.

As shown in FIG. 2A, or the like, each of the cores 5*a* and 5*b* is formed by a ferrite core of which a section in a length direction (a longitudinal direction in FIG. 1 and FIGS. 2A and 2B) has an "E" shape. That is, the cores 5*a* and 5*b* are formed of a ferrite magnetic substance material. The cores 5*a* and 5*b* form a magnetic path of the magnetic flux generated by the coil 4.

In FIG. 2A, or the like, the upper core 5*a* disposed on an upper side includes a base portion 5*c*, and three projection portions 5*e*, 5*f*, and 5*g* that protrude downwards from the base portion 5*c*. The projection portions 5*e*, 5*f*, and 5*g* are disposed in a line in the longitudinal direction (the longitudinal direction in FIG. 1 to FIG. 2B) of the upper core 5*a*.

The lower core 5*b* that is disposed on a lower side includes a base portion 5*d*, and three projection portions 5*h*, 5*i*, and 5*j* that protrude upwards from the base portion 5*d*. The projection portions 5*h*, 5*i*, and 5*j* are disposed in a line in the length direction (the longitudinal direction in FIG. 1 to FIG. 2B) of the lower core 5*b*.

A protruding height, from the base portions 5*c* and 5*d*, of the projection portions 5*e*, 5*g*, 5*h*, and 5*j* that are disposed on the right and left is greater than that of the projection portions 5*f* and 5*i* that are disposed at the center of the cores 5*a* and 5*b*.

Tip surfaces (lower ends) of the left and right projection portions 5*e* and 5*g* of the upper core 5*a* and tip surfaces (upper ends) of the left and right projection portions 5*h* and 5*j* of the lower core 5*b* are in close contact with each other, so that the cores 5*a* and 5*b* are combined. Further, in both end portions of the cores 5*a* and 5*b* in the longitudinal direction, a column portion 5L formed by the projection portions 5*e* and 5*h* and one end portions of the base portions 5*c* and 5*d*, and a column portion 5*r* formed by the projection portions 5*g* and 5*j* and the other end portions of the base portions 5*c* and 5*d* are formed. The projection portion 5*f* of the upper core 5*a* and the projection portion 5*i* of the lower core 5*b* face each other with a gap of a predetermined size.

The projection portions 5*f* and 5*i* are disposed inside a winding portion 4*a* of the coil 4. The column portions 5L and 5*r* are disposed outside the winding portion 4*a* of the coil 4. That is, the coil 4 is disposed between the column portions 5L and 5*r* of the cores 5*a* and 5*b*, and the winding of the coil 4 is wound around the projection portions 5*f* and 5*i*. Thus, when a high current flows in the coil 4, a predetermined inductance is realized, and a direct current superimposition characteristic of the inductance is enhanced by the gap between the projection portions 5*f* and 5*i*.

Between the cores 5*a* and 5*b*, and the coil 4, a bobbin 6 is provided. The bobbin 6 is formed of an insulator made of a synthetic resin, and insulates the cores 5*a* and 5*b*, and the coil 4.

As shown in FIG. 1, the cores 5*a* and 5*b* are disposed at a predetermined position on the housing 1, and cover a most part of the winding portion 4*a* of the coil 4. Further, as shown in FIG. 2A, or the like, the lower core 5*b* is supported by the housing 1 from a lower side. On a contact surface X of the lower core 5*b* and the housing 1, a lubricating oil, a sheet, or the like having thermal conductivity and insulation performance may be interposed. The housing 1 is an example of a "support member" of one or more embodiments of the invention.

Stands 1*a* are vertically provided on the housing 1 to be positioned on both sides of the cores 5*a* and 5*b* in the longitudinal direction. The heights of the stands 1*a* from the housing 1 are set to be higher than the heights of the cores 5*a* and 5*b*. On each stand 1*a*, a root portion of a leaf spring 7 is fixed by the screw 8. A tip portion of each leaf spring 7 presses each of both end portions of the upper core 5*a* in the longitudinal direction. That is, each leaf spring 7 presses each of the column portions 5L and 5*r* of the cores 5*a* and 5*b* onto the housing 1 from above at the tip portion thereof to fix the cores 5*a* and 5*b* to the housing 1. The leaf spring 7 and the screw 8 are an example of a "fixing member" of one or more embodiments of the invention. As another example, a structure in which the height of the stand 1*a* is set to be the same or lower than the height of the cores 5*a* and 5*b*, the longitudinal of the leaf spring 7 is set to become long, and each of the cores 5*a* and 5*b* is pressed from the top using the leaf spring 7 may be used.

A load when the leaf spring 7 presses each of the cores 5*a* and 5*b* is set to such a size that each of the cores 5*a* and 5*b* is not separated from the housing 1 even in a case where an external force such as large vibration or shock is applied to the electronic apparatus 100 or the magnetic part 3 from an engine of a vehicle, for example.

The column portions 5L and 5*r* of the cores 5*a* and 5*b* are provided, at both end portions of the cores 5*a* and 5*b* in the longitudinal direction that are parallel to the contact surface X of the cores 5*a* and 5*b*, and the housing 1, to be vertical with respect to the contact surface X. An upper end portion of each of the column portions 5L and 5*r* is pressed downwardly by the leaf spring 7, and a lower end portion of each of the column portions 5L and 5*r* is supported by the housing 1.

A recess 1*b* is formed in a portion of a facing surface 1*c* of the housing 1 that faces the lower core 5*b*, which is not in contact with the column portions 5L and 5*r* of the cores 5*a* and 5*b*. Accordingly, a portion other than the lower end portions of the column portions 5L and 5*r* of the cores 5*a* and 5*b* is not in contact with the housing 1.

Figure 3A:
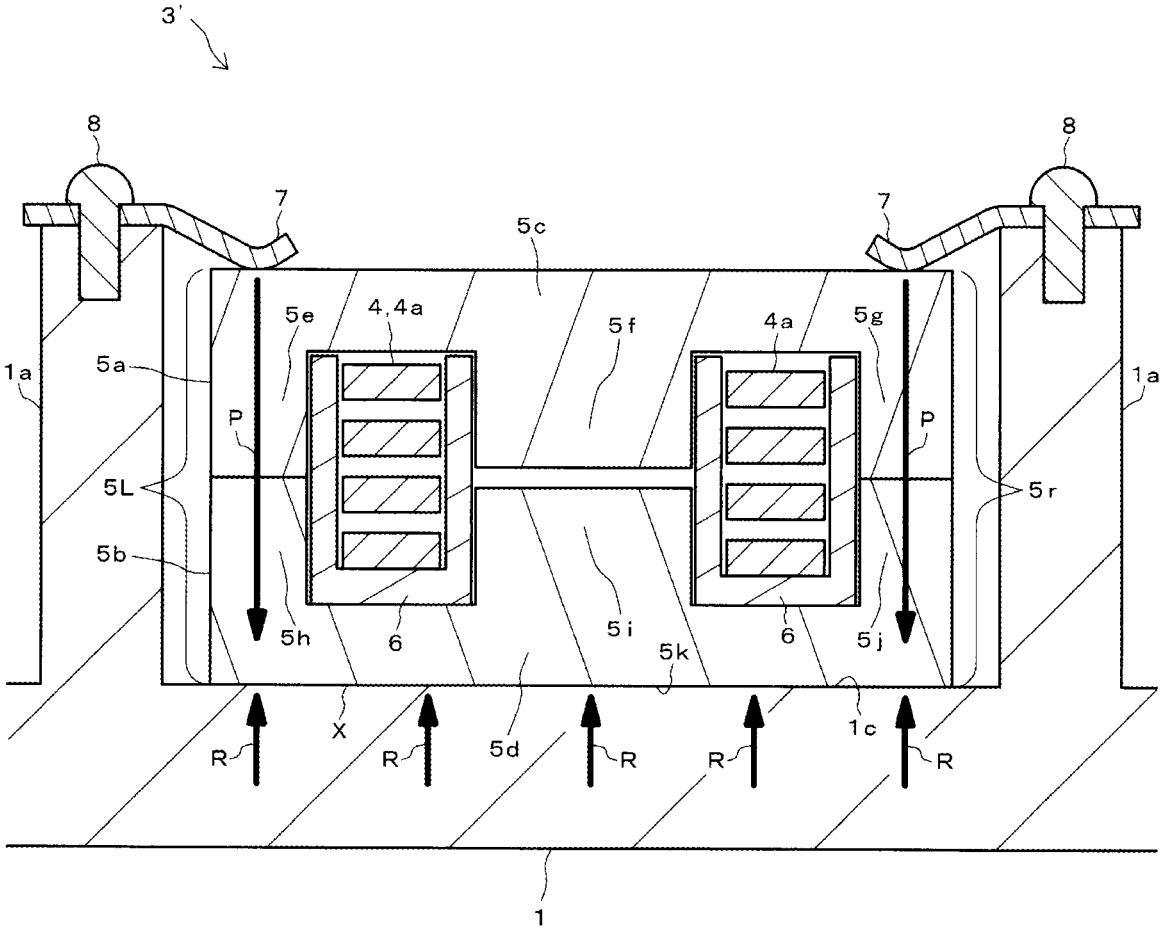
FIG. 3A is a section view of a magnetic part in the related art.
Figure 3B:
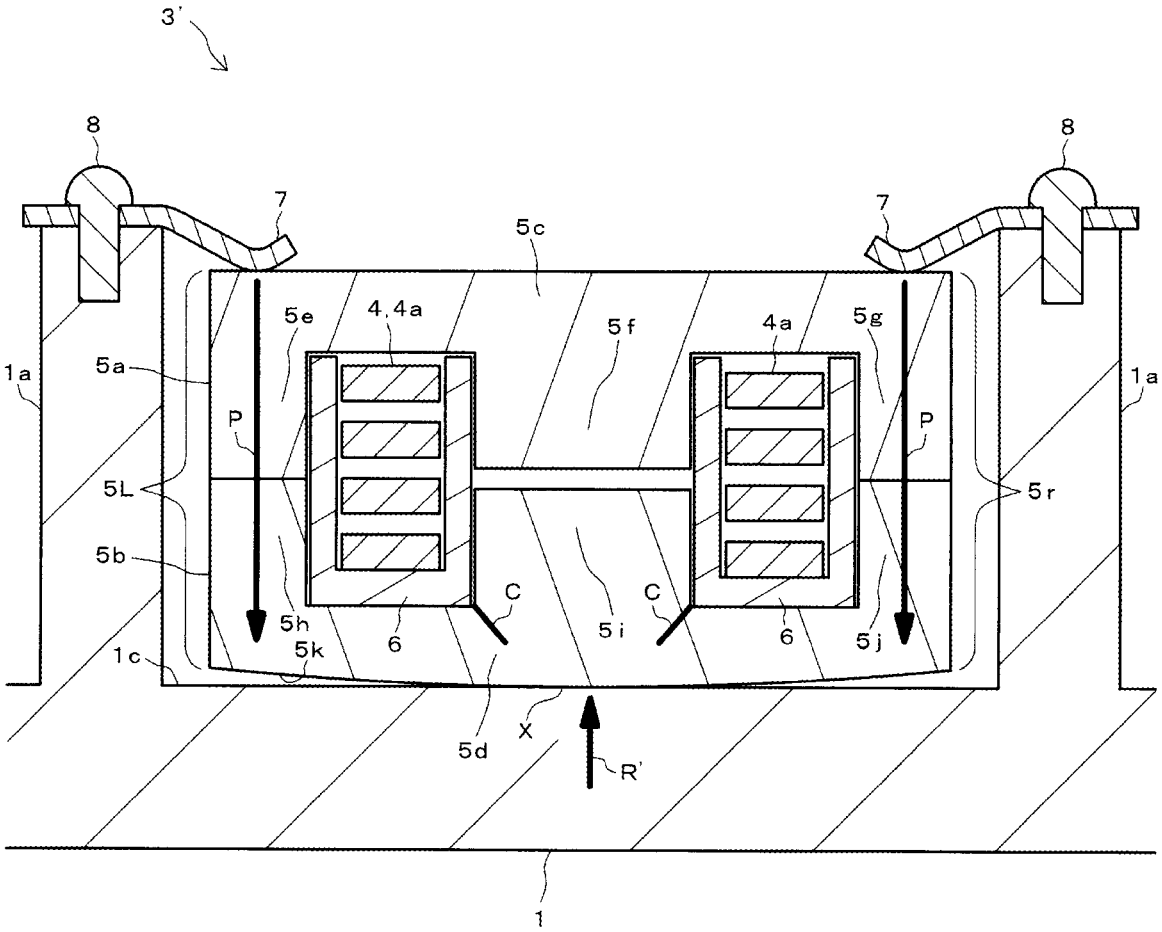
FIG. 3B is a section view of the magnetic part in the related art.
Figure 4:
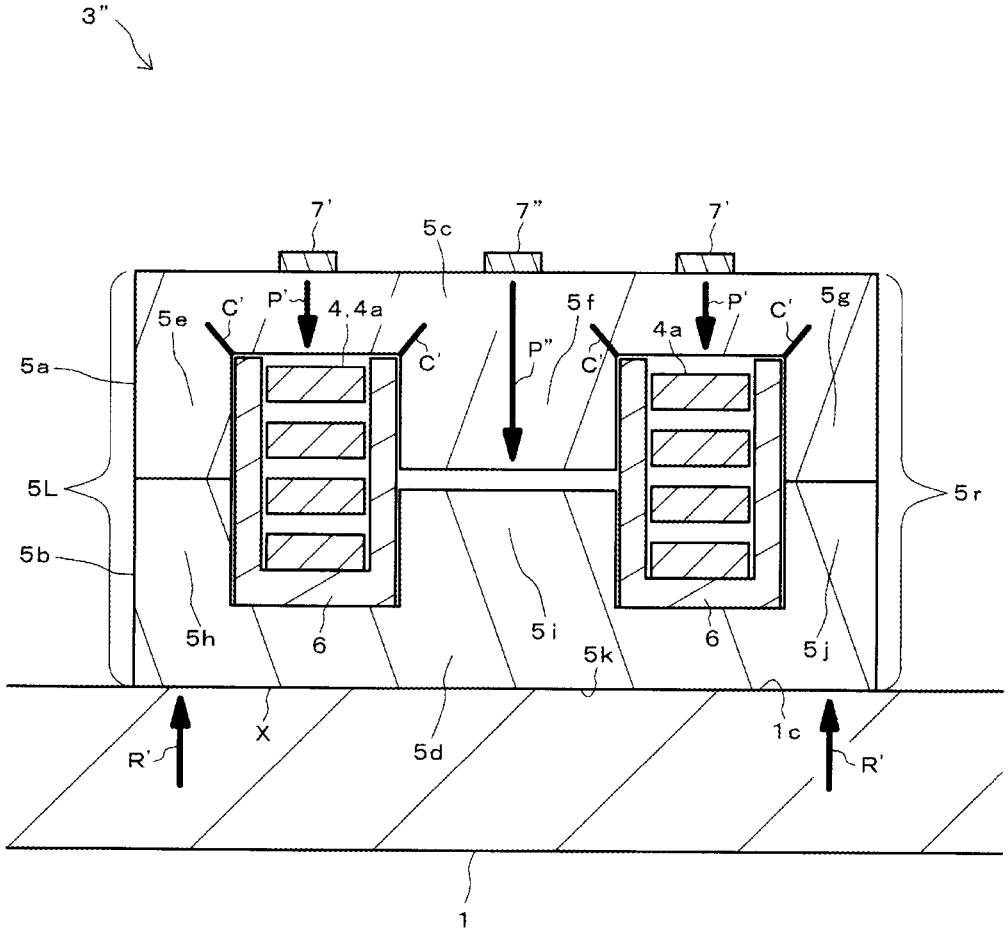
FIG. 4 is a section view of a magnetic part in the related art.

FIGS. 3A, 3B, and FIG. 4 are section views of magnetic parts 3' and 3" in the related art. In the related art, as shown in FIGS. 3A, 3B, and FIG. 4, a facing surface 1*c* of a housing 1 that faces a lower core 5*b* is flat and flush, and an entire region of a lower surface of the lower core 5*b* is in contact with the housing 1.

Accordingly, as shown in FIG. 3A, in an ideal state where a facing surface 5*k* of the lower core 5*b* that faces the housing 1 is flat and a warp does not occur on the facing surface 5*k*, a reaction force R from the housing 1, with respect to a pressing force P for pressing downward the cores 5*a* and 5*b* by a leaf spring 7, acts in a state of being dispersed in a base portion 5*d* of the lower core 5*b*.

However, due to problems in manufacturing of the cores 5*a* and 5*b*, there is variance in dimensions of the cores 5*a* and 5*b*, and thus, as shown in FIG. 3B, a warp that protrudes toward the housing 1 as it goes to the center may occur on the facing surface 5*k* of the lower core 5*b* that faces the housing 1. In this case, even though upper end portions of the column portions 5L and 5*r* of the cores 5*a* and 5*b* are pressed downward by the leaf springs 7, only the highest central portion of the facing surface 5*k* of the lower core 5*b* is in contact with the housing 1, and thus, gaps are generated between the lower core 5*b* and the housing 1 in a direction (in a downward direction in FIG. 3B) where the pressing forces P from the leaf springs 7 act. Accordingly, the pressing forces P from the leaf springs 7 to the cores 5*a* and 5*b* and a reaction force R' from the housing 1 to the cores 5*a* and 5*b* do not act on the same line. Accordingly, a large bending stress or shearing stress is applied to the lower cores 5*b*, and thus, the lower core 5*b* is easily broken. Particularly, as shown in FIG. 3B, cracks C occur from root portions of the projection portion 5*i* of the lower core 5*b* toward the base portion 5*d*, and thus, the lower core 5*b* is easily broken.

Further, due to a design problem of the electronic apparatus 100 or the magnetic part 3, as shown in FIG. 4, there is a case where a central portion of the upper core 5*a* is pressed downward using a leaf spring 7' or a leaf spring 7", in place of the upper end portions of the column portions 5L and 5*r* of the cores 5*a* and 5*b*. In this case, since a space (a space where the coil 4 is contained or a gap between the projection portions 5*f* and 5*i*) is present from the upper core 5*a* to the housing 1, in a direction (in a downward direction in FIG. 4) of pressing forces P' and P" of the respective leaf springs 7' and 7", a large bending stress or shearing stress is applied to the upper core 5*a*, and thus, the upper core 5*a* easily cracks. Particularly, as shown in FIG. 4, cracks C' occur from root portions of the projection portion 5*f* of the upper core 5*a* toward the base portion 5*c*, and thus, the upper core 5*a* is easily broken.

On the other hand, in this embodiment, as shown in FIG. 2A, or the like, since the column portions 5L and 5*r* of the cores 5*a* and 5*b* are pressed to the housing 1 by the leaf springs 7, a space is not present between the cores 5*a* and 5*b* and the housing 1, in the direction where the pressing force P from the leaf spring 7 acts. Accordingly, by suppressing a bending stress or shearing stress applied to the upper core 5*a* to become small, it is possible to prevent breakage of the upper core 5*a*.

Further, the recess 1*b* is formed in a portion of the facing surface 1*c* of the housing 1 that faces the cores 5*a* and 5*b*, which is not in contact with the column portions 5L and 5*r* of the cores 5*a* and 5*b*. Accordingly, as shown in FIG. 2B, even though a warp that protrudes toward the housing 1 as it goes to the center thereof occurs on the facing surface 5*k* of the lower core 5*b* that faces the housing 1, the highest central portion of the facing surface 5*k* of the lower core 5*b* is inserted into the recess 1*b*, and thus, the central portion is not in contact with the housing 1. Accordingly, it is possible to cause only the lower end portions of the column portions 5L and 5*r* of the cores 5*a* and 5*b* on which the pressing forces P from the leaf springs 7 act to be in contact with the housing 1. Further, a gap between the lower core 5*b* and the housing 1 is not generated in the direction where the pressing force P from the leaf spring 7 acts, and the pressing forces P from the leaf springs 7 to the cores 5*a* and 5*b* and the reaction forces R from the housing 1 to the cores 5*a* and 5*b* act on the same line. Thus, it is possible to suppress a bending stress or shearing stress applied to the lower core 5*b* to become small, to thereby prevent breakage of the lower core 5*b*.

As a result, it is possible to reliably fix the cores 5*a* and 5*b* to the housing 1 using the leaf springs 7, and to prevent breakage of the cores 5*a* and 5*b*. Further, it is possible to prevent performance of the magnetic part 3 and the electronic apparatus 100 from deteriorating due to the breakage of the cores 5*a* and 5*b*.

Further, since a configuration in which pressing forces of the leaf springs 7 to the cores 5*a* and 5*b* are reduced, and in this case, adhesion, bonding, or the like is performed as reinforcement means, as in the related art, is not employed, it is possible to prevent increase in the number of manufacturing processes of the magnetic part 3 or the electronic apparatus 100 and increase in the manufacturing cost.

Further, in this embodiment, the column portions 5L and 5*r* are provided at both end portions of the cores 5*a* and 5*b* in the longitudinal direction, in the direction that is parallel to the contact surface X of the lower core 5*b* and the housing 1. Thus, by pressing the respective column portions 5L and 5*r* onto the housing 1 from above using the leaf springs 7, it is possible to stably and reliably fix the cores 5*a* and 5*b* to the housing 1.

Further, in this embodiment, the housing 1 of the electronic apparatus 100 is formed of a heat radiator, and the cores 5*a* and 5*b* are fixed to the housing 1 to be in close contact therewith. Thus, when the current flows through the coil 4, it is possible to transfer heat emitted from the cores 5*a* and 5*b* to the housing 1 from the column portions 5L and 5*r*, and to radiate the heat from the housing 1 to the outside. Further, it is possible to prevent the cores 5*a* and 5*b* from entering a thermal runaway state, to thereby prevent deterioration of the performance of the magnetic part 3 or the electronic apparatus 100.

The invention may employ various embodiments, in addition to the above-described embodiment. For example, in the above-described embodiment, an example in which the cores 5*a* and 5*b* are supported or fixed onto the housing 1 of the electronic apparatus 100 is shown, but the invention is not limited thereto. For example, a configuration in which the cores 5*a* and 5*b* are supported by a support member other than the housing 1, the cores 5*a* and 5*b* are fixed to the support member using the leaf springs 7, and the support member is fixed to the housing 1 using fixing means such as screws or an adhesive may be employed.

Further, in the above-described embodiment, an example in which two ferrite cores 5*a* and 5*b* having "E" shaped sections are vertically combined to form a core is shown, but the invention is not limited thereto. For example, a configuration in which a core having an "E" shaped section and a core having an "I" shaped section are combined to form a core may be employed. Further, only one core having a different shape may be used, or three or more cores may be combined to form a core. Further, a core formed of a magnetic material other than ferrite may be used. In addition, the number of column portions formed in the core may be one, or may be three or more.

Further, in the above-described embodiment, an example in which an edge-wise coil is used as the coil 4 is shown, but the invention is not limited thereto. For example, a coil in which a winding is formed by a wiring pattern on a printed board may be used. In addition, a coil in which a section of a winding is a different shape such as a square shape, a circular shape, or the like other than a straight angle shape may be used.

Further, in the above-described embodiment, an example in which the cores 5*a* and 5*b* are fixed to the housing 1 using the leaf springs 7 and the screws 8 is shown, but the invention is not limited thereto. For example, a fixing tool of a metallic material or a synthetic resin may be used as a fixing member that fixes a core. In addition, two or more fixing members as described above may be combined, or the fixing member and an adhesive, an adhesive tape, or the like may be used together. Further, the number of locations where a core is held by being pressed by a fixing member may be one or plural. Furthermore, the number of locations where a core is held by a support member may be one or plural.

Further, in the above-described embodiment, an example in which one recess 1*b* is provided in the housing 1 is shown, but the invention is not limited thereto. For example, a plurality of recesses may be provided in a facing portion of the housing 1 that faces a portion other than the column portions 5L and 5*r* of the cores 5*a* and 5*b*. Further, in order to easily transfer heat of the cores 5*a* and 5*b* to the housing 1, a lubricating oil, an elastic sheet, or the like having thermal conductivity and insulation performance may be provided in the recess. In addition, on the surface X where the cores 5*a* and 5*b* are in contact with the housing 1, a lubricating oil, an elastic sheet, or the like having thermal conductivity and insulation performance may be interposed.

Further, in the above-described embodiment, an example in which the invention is applied to the magnetic part 3 formed of a choke coil is shown, but the invention may be applied to another magnetic part such as a transformer.

Further, in the above-described embodiment, an example in which the invention is applied to the electronic apparatus 100 formed of an in-vehicle DC-DC converter that is provided in the vicinity of an engine of a vehicle and the magnetic part 3 provided in the electronic apparatus 100 is shown, but the invention may be applied to different in-vehicle electronic apparatuses, electronic apparatuses other than the in-vehicle electronic apparatus, and a magnetic part provided therein.

While the invention has been described with respect to a limited number of embodiments, those skilled in the art, having benefit of this disclosure, will appreciate that other embodiments can be devised which do not depart from the scope of the invention as disclosed herein. According, the scope of the invention should be limited only by the attached claims.

The invention claimed is:

1. A magnetic part comprising:

a coil that generates a magnetic flux when a current flows through the coil;

a core that is formed of a magnetic substance that forms a magnetic path of the magnetic flux;

a support member that supports the core; and a fixing member that fixes the core to the support member, wherein the core comprises:

a column portion that is vertically provided with respect to a contact surface of the core that contacts the support member, where the column portion is disposed outside of a winding of the coil; and a projection portion, disposed within the winding of the coil, that extends in a vertical direction that is perpendicular to a cross-section of the winding of the coil, wherein the fixing member presses the column portion of the core against the support member, wherein the support member has a recess in a portion of a facing surface that faces the core, wherein the recess does not face the column portion of the core, wherein the recess overlaps, in the vertical direction, the cross-section of the winding of the coil and a cross-section of a gap of the core formed by the projection portion of the core, wherein the support member further comprises a protruding portion that constitutes a stand that is vertically provided lateral to the core, where the closest point of the stand relative to the recess is disposed apart from the recess at a predetermined distance that is greater than a width of the column portion of the core, and wherein the fixing member comprises a leaf spring, the leaf spring comprising a root portion fixed to the stand and a tip portion in contact with the column portion of the core to press the core against the support member.

2. The magnetic part according to claim 1, wherein the column portion is provided in each of both end portions of the core in a direction parallel to the surface where the core is in contact with the support member, and wherein the recess is provided in the support member to be opened toward a space between the column portions.

3. The magnetic part according to claim 1, wherein the core is configured by combining two cores that are formed to have "E" shaped sections in a longitudinal direction such that projection portions formed in both end portions of the two cores in the longitudinal direction are in close contact with each other to form the column portions.

4. The magnetic part according to claim 1, wherein the support member is formed of a heat radiator that radiates heat emitted from the core.

5. An electronic apparatus comprising:

the magnetic part according to claim 1;

a board to which the coil of the magnetic part is electrically connected; and a housing that is attached to the magnetic part and the board, wherein the support member of the magnetic part is distinct from the housing, and wherein the support member of the magnetic part is fixed to the housing by another fixing member.

6. A magnetic part comprising:

a coil that generates a magnetic flux when a current flows through the coil;

a core that is formed of a magnetic substance that forms a magnetic path of the magnetic flux, wherein the core comprises a contact surface;

a support member that supports the core, wherein the support member comprises a facing surface that faces the core and wherein the facing surface of the support member supports the core only at the contact surface of the core; and a fixing member that fixes the core to the support member by pressing only a column portion of the core, disposed outside of a winding of the coil, against the facing surface of the support at the contact surface of the core, wherein the core includes a projection portion, disposed within the winding of the coil, that extends in a first direction that is perpendicular to a cross-section of the winding of the coil, wherein the support member comprises a recess in a portion of the facing surface of the support member, wherein the recess does not support the contact surface of the core wherein the recess overlaps, in the first direction, the cross-section of the winding of the coil and a cross-section of a gap of the core formed by the projection portion of the core, wherein the support member further comprises a protruding portion that constitutes a stand that is vertically provided lateral to the core, where the closest point of the stand relative to the recess is disposed apart from the recess at a predetermined distance that is greater than a width of the column portion of the core.

7. The magnetic part of claim 6, wherein the fixing member comprises a leaf spring, the leaf spring comprising a root portion fixed to the stand and a tip portion in contact with the column portion of the core to press the core against the facing surface of the support member.

* * * * *